US006528694B1

(12) United States Patent
Chiga

(10) Patent No.: US 6,528,694 B1
(45) Date of Patent: Mar. 4, 2003

(54) ADMIXTURE COMPOSITION FOR MIXING WITH LUBRICANT

(75) Inventor: Shunsuke Chiga, Tokyo (JP)

(73) Assignee: Japan Pacific Enterprise, Inc., Tokyo (JP)

( * ) Notice: Subject to any disclaimer, the term of this patent is extended or adjusted under 35 U.S.C. 154(b) by 0 days.

(21) Appl. No.: 10/142,034

(22) Filed: May 9, 2002

(30) Foreign Application Priority Data

Mar. 7, 2002 (JP) ..... 2002-061942

(51) Int. Cl.[7] ..... C10M 101/02

(52) U.S. Cl. ..... 585/11; 508/591; 585/13; 585/10

(58) Field of Search ..... 508/591; 585/10, 585/11, 12, 13

(56) References Cited

U.S. PATENT DOCUMENTS 4,116,917 A * 9/1978 Eckert ..... 585/11
4,788,362 A 11/1988 Kaneko ..... 585/10
4,952,738 A * 8/1990 Gessell et al. ..... 585/3
5,458,796 A * 10/1995 Storey et al. ..... 508/591
6,034,042 A * 3/2000 Rhodes ..... 508/591
6,214,779 B1 * 4/2001 Kaneshige et al. ..... 508/591

FOREIGN PATENT DOCUMENTS

EP 0629689 * 12/1994

* cited by examiner

*Primary Examiner*—Jacqueline V. Howard
(74) *Attorney, Agent, or Firm*—Heslin Rothenberg Farley & Mesiti P.C.

(57) ABSTRACT

In order to provide an improvement in the mechanical shear force resistance of the admixture composition, comprising an oil solution of polyisobutylene, containing polyisobutylene having a viscosity average molecular weight in a range of 350,000 to 2,100,000 at a concentration in the range of 10 weight % to 90 weight % and an oil solution of star divinylbenzene-isoprene copolymer hydride being a viscosity index improver, containing star divinylbenzene-isoprene copolymer hydride having a viscosity average molecular weight in a range of 200,000 to 800,000 at a concentration in the range from 3 weight % to 90 weight %, and said oil solution of polyisobutylene mixes with a lubricant at a concentration in the range from 10 weight % to 90 weight % and said oil solution of star divinylbenzene-isoprene copolymer hydride mixes with the lubricant at a concentration in the range of 3 weight % to 90 weight %.

2 Claims, 2 Drawing Sheets

ADMIXTURE COMPOSITION FOR MIXING WITH LUBRICANT

BACKGROUND OF THE INVENTION

1. Field of the Invention

The present invention relates to admixture composition for mixing with a lubricant that is used for various purposes.

2. Description of the Related Art

Admixture composition for improving the performances of lubricants by being mixed with lubricants that are used for various purposes such as in internal combustion engine oils, automatic transmission fluids (ATF), hydraulic oils in an airline industry, shock absorber oils and the like, to achieve a hydrodynamic nature of the resultant lubricants as a non-Newtonian elastic fluid, are proposed in U.S. Pat. No. 4,788,362. In U.S. Pat. No. 4,788,362, it is proposed that an admixture composition comprising an oil solution of polyisobutylene and an oil solution of an olefin copolymer or polymethacrylate. The oil solution of polyisobutylene contains polyisobutylene having a viscosity average molecular weight of 350,000–2,100,000 at a concentration in the range of 10 weight % to 90 weight %. When the admixture composition mixes with a lubricant, the oil solution of polyisobutylene mixes with the lubricant at a concentration in the range of 10 weight % to 90 weight %. The oil solution of an olefin copolymer or polymethacrylate is a viscosity index improver.

Mixing such admixture composition as those in U.S. Pat. No. 4,788,362 into the lubricants provides advantageous effects such as efficient fuel consumption in internal combustion engines such as those in automobiles, prevention of sticking, clarification of exhaust gas, decrease in abrasion, decrease in deterioration of the lubricant, i.e., extended durability of the lubricant which leads to a reduction in lubricant consumption and extended durability in the engine and so on. Further, the advantageous effects such as decrease in abrasion and reduction of fuel cost and power cost and so on are provided if the lubricants, with which such admixture composition are mixed, are used as operation fluids, gear fluids, general machine fluids and so on.

A variety of advantageous effects associated with environmental protection such as clarification of exhaust gas and reduction of waste oils or waste materials and so on are obtained by mixing the admixture composition of U.S. Pat. No. 4,788,362 with the lubricants. However, in the situation of the increasingly tight regulations related to environmental protection that has arisen in recent years, it is desired that the advantageous effects obtained by mixing the admixture composition of U.S. Pat. No. 4,788,362 with the lubricants are capable of being maintained for longer.

Deterioration of the admixture composition involves deterioration of the above-mentioned various advantageous effects obtained by mixing the admixture composition of U.S. Pat. No. 4,788,362 with lubricants. And, the deterioration of the admixture composition mainly occurs by mechanical shearing which is applied to the admixture composition. Therefore, it is necessary to improve the durability of the admixture composition against mechanical shearing, in order to maintain the advantageous effects obtained by mixing the admixture composition of U.S. Pat. No. 4,788,362 to lubricants for a longer term.

An object of the present invention is to improve the durability of the admixture composition against mechanical shearing.

SUMMARY OF THE INVENTION

A admixture composition for mixing with a lubricant of the present invention provides a solution to the above-indicated object by comprising an oil solution of polyisobutylene and an oil solution of star divinylbenzene-isoprene copolymer hydride. The oil solution of polyisobutylene contains polyisobutylene having a viscosity average molecular weight in a range of 350,000 to 2,100,000 at a concentration in the range of 10 weight % to 90 weight % and the oil solution of star divinylbenzene-isoprene copolymer hydride contains star divinylbenzene-isoprene copolymer hydride having a viscosity average molecular weight in a range of 200,000 to 800,000 at a concentration in the range from 3 weight % to 90 weight %. When the admixture composition mixes with a lubricant, the oil solution of polyisobutylene mixes with a lubricant at a concentration in the range from 10 weight % to 90 weight % and the oil solution of star divinylbenzene-isoprene copolymer hydride mixes with the lubricant at a concentration in the range of 3 weight % to 90 weight %. The oil solution of star divinylbenzene-isoprene copolymer hydride being a viscosity index improver The deterioration of the admixture composition is mainly involved the deterioration of the viscosity index improver. More specifically, the viscosity index improver deteriorates by being applied with a mechanical shearing action to become impossible to prevent a change in the viscosity of the admixture composition, thereby leading to the deterioration of the admixture composition. In this way, the admixture composition of the present invention can improve the durability of the viscosity index improver against the mechanical shearing by employing star divinylbenzene-isoprene copolymer hydride as a viscosity index improver.

Moreover, even though the durability of the viscosity index improver against the mechanical shearing can be improved by employing star divinylbenzene-isoprene copolymer hydride, it is not desirable if the performances of the present admixture composition become worse than ones of the admixture composition of U.S. Pat. No. 4,788,362, since the various advantageous effects, that are obtained by mixing the admixture composition of U.S. Pat. No. 4,788,362 to lubricants, may not be obtained. Thus, in addition to comprising an oil solution of polyisobutylene, which contains polyisobutylene having a viscosity average molecular weight in a range of 350,000 to 2,100,000 at a concentration in the range of 10 weight % to 90 weight %, the present invention provides comprising an oil solution of star divinylbenzene-isoprene copolymer hydride, which contains star divinylbenzene-isoprene copolymer hydride having a viscosity average molecular weight in a range of 200,000 to 800,000 at a concentration in the range of 3 weight to 90 weight %, thereby preventing that the performances of the admixture composition becomes worse than ones of the admixture composition of U.S. Pat. No. 4,788,362. Also, when the admixture composition mixes with a lubricant, the oil solution of polyisobutylene mixes with a lubricant at a concentration in the range of 10 weight % to 90 weight % and the oil solution of star divinylbenzene-isoprene copolymer hydride mixes with the lubricant at a concentration in the range of 3 weight % to 90 weight %.

Therefore, the admixture composition of the present invention improves the durability of the admixture composition against the mechanical shearing, by employing the above-mentioned constitution.

Further, the star divinylbenzene-isoprene copolymer hydride of the present invention may have a viscosity average molecular weight within a range of 400,000 to 650,000. In this constitution, the effects as the viscosity index improver and the necessary fluidity can be more surely obtainable, and thus this is preferable.

DESCRIPTION OF THE PREFERRED EMBODIMENTS

An admixture composition for mixing with a lubricant according to the present invention comprises an oil solution of a polyisobutylene (hereinafter called PIB) having a viscosity average molecular weight, i.e. Flory, of 350,000–2,100,000. The PIB oil solution is prepared by dissolving PIB having a viscosity average molecular weight of 350,000–2,100,000 in a base oil for a lubricant at a concentration in the range of 10 weight % to 90 weight %. The PIB oil solution is mixed with a lubricant at a concentration in the range of 10 weight % to 90 weight %.

Likewise, the admixture composition for mixing with a lubricant according to the present invention comprises an oil solution of a star divinylbenzene-isoprene copolymer hydride (hereinafter called DICH),i.e. divinylbenzene-isoprene copolymer hydride having a star structure and a viscosity average molecular weight of 200,000–800,000. The DICH oil solution is prepared by dissolving star DICH having a viscosity average molecular weight of 200,000–800,000 in the base oil for a lubricant at a concentration in the range of 3 weight % to 90 weight %. The DICH oil solution is mixed with a lubricant at a concentration in the range of 3 weight % to 90 weight %.

Here, one may suitably use, for the base oil for forming these oil solutions that constitute the admixture composition, a base oil for the lubricant which is mixed with this admixture composition or another type of base oil for lubricant that is different from the base oil for the lubricant which is mixed with this admixture composition. The admixture composition of the present invention may be mixed with a lubricant during the production of the lubricant, or may be produced as a commercial product as an additive, which is mixed with a lubricant that has also been produced as a commercial product separately. Also, the admixture composition of the present invention may be mixed with the lubricant together with various additive components and the like other than PIB and star DICH. The additive components other than PIB and star DICH may be a component for forming a cleaning dispersion agent, an oxidation inhibitor, a pour-point depressant, an oil agent, an anti-rust agent, a temperature stabilizing agent, a shear stabilizing agent, a scavenging agent, an anti-abrasion agent and the like. If the admixture composition of the present invention is produced as a commercial product of an additive, an additive component such as those listed above other than PIB and star DICH may be included into the additive.

Figure 1:
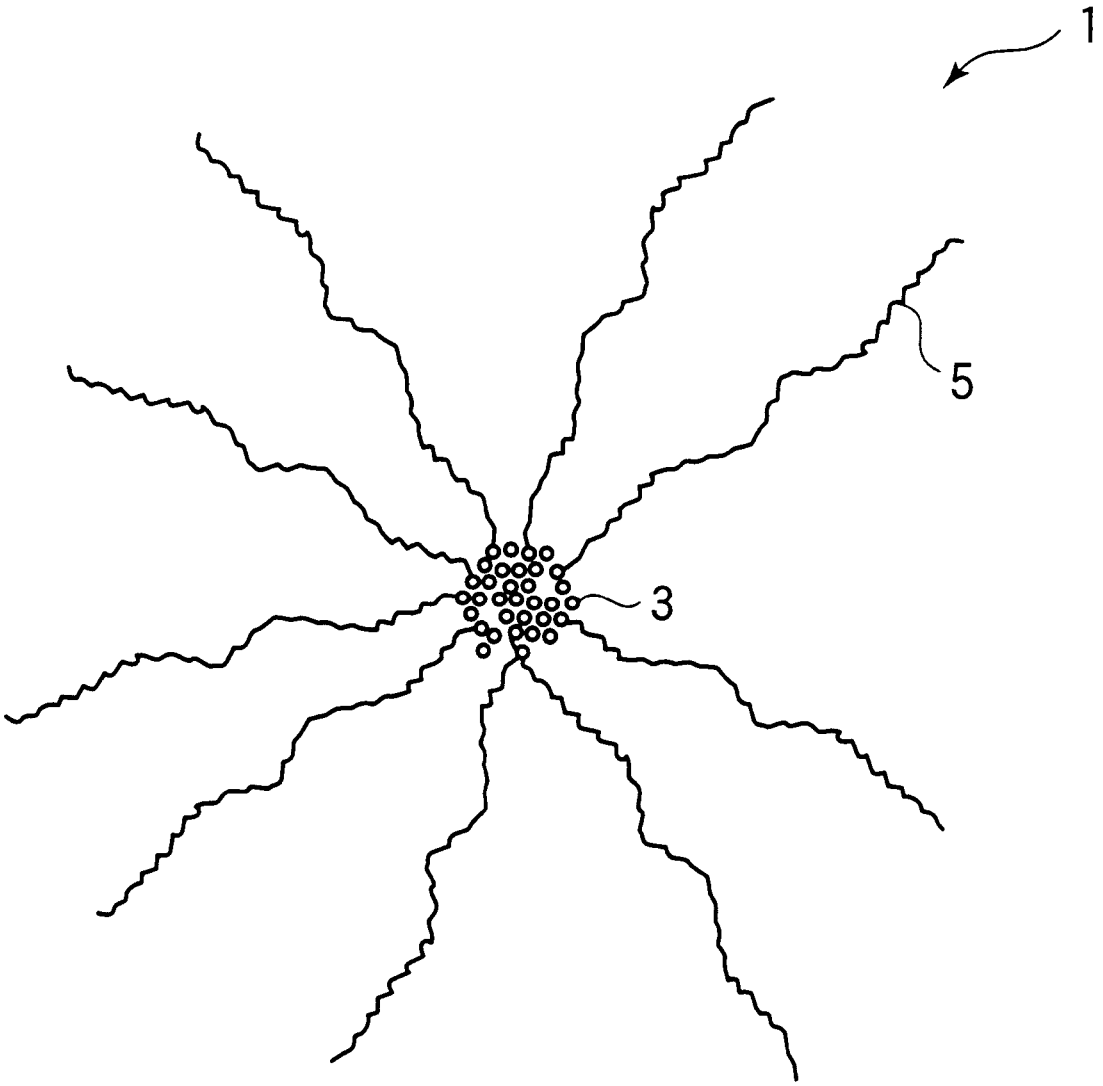
FIG. 1 is a schematic diagram of the molecular structure of a star divinylbenzene-isoprene copolymer hydride.

The viscosity index improver is to improve the viscosity index (hereinafter called VI), which is used as a measure for indicating the viscosity-temperature relationship of the lubricant. The admixture composition of the present invention employs star DICH as the viscosity index improver. Star DICH has, as shown in FIG. 1, a star-shaped structure having chain-polymerized isoprene molecular chains 5 radially extending from a centrally polymerized divinylbenzene molecular cluster 3. Such a molecular structure provides higher mechanical shear force resistance to the viscosity index improver of the present invention than a conventional viscosity index improver formed by olefin copolymer or polymethacrylate. The structural formula of star DICH employed in the present invention is as shown in the following Formula 1:

(Formula 1)

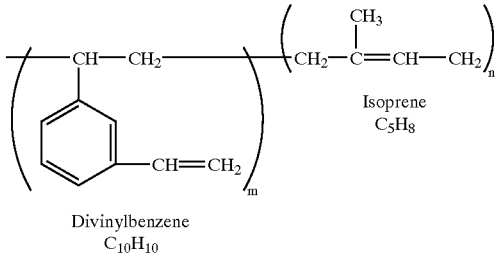

Further, the DICH oil solution including the star DICH is designed to be a viscous oil solution at a concentration in the range of 3 weight % to 90 weight % for the purpose of easily dissolving this DICH oil solution into a lubricant. Such DICH oil solution is mixed with a lubricant at a concentration in the range of 3 weight % to 90 weight %. Here, the mixing quanitity of the DICH oil solution to the lubricant may be selected from the range of 3 weight % to 90 weight %, depending on the viscosity grade of the lubricant and so on.

An excessively small viscosity average molecular weight of the star DICH may provide an excessively lower concentration of star DICH, and may be unable to provide the advantageous effects of the viscosity index improver. On the contrary, an excessively larger viscosity average molecular weight of the star DICH may provide an excessively higher concentration of star DICH, thereby providing an excessively higher viscosity of the admixture composition, and may decrease the fluidity of the lubricant in which the admixture composition is mixed. In addition, an excessively larger viscosity average molecular weight of the star DICH may also increase the cost of the admixture composition. Accordingly, the viscosity average molecular weight of the star DICH is selected from the range of 200,000 to 800,000, and more preferably the viscosity average molecular weight of the star DICH is selected from the range of 400,000 to 650,000.

PIB, which constitutes the admixture composition of the present invention together with star DICH, is formed of a long-chain molecular polymer of highly saturated aliphatic hydrocarbons, and unsaturated groups are included only at the ends of the chains. Because of such a molecular structure of PIB, PIB is soluble to hydrocarbon solvents, and relatively stable to chemicals, thereby providing higher chemical resistance and higher anti-oxidizing ability. The struc tural formula of PIB employed in the present invention is shown in the following Formula 2:

(Formula 2)

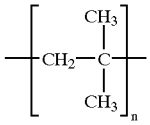

Polyisobutylene

Further, the PIB oil solution including PIB is designed to be a viscous oil solution at a concentration in the range of 10 weight % to 90 weight % so that this PIB oil solution is easily dissolved into a lubricant. Such a PIB oil solution is mixed with a lubricant at a concentration in the range of 10 weight % to 90 weight %. Here, the mixing quantity of the PIB oil solution to the lubricant may be selected in the range of 10 weight % to 90 weight %, depending on the grade of the lubricant and so on.

If the admixture composition of the present invention is produced as a additive to be additionally mixed with a lubricant that is a commercial product, the quantity added should be smaller than the quantity in which the admixture composition of the present invention is mixed during the production of the commercial product of the lubricant. Accordingly, when the admixture composition of the present invention is produced as a commercial product of an additive, PIB and star DICH in the admixture composition should be included at higher concentrations than in the case of mixing during the production of the lubricant. In this case, the extent of the concentration depends on the mixing ratio of the admixture composition to the lubricant.

EXAMPLES

An example of the shear stability tests under a diesel injector test for the 5 different types of viscosity grades of liquid lubricants in which the admixture composition according to the present invention are mixed follows. In these tests, the shear stability tests were performed for Examples 1–5 and Controls 1–5, based on CEC-L-14-A-93 and/or DIN51382. Examples 1–5 are the admixture composition according to the present invention, and Controls 1–5 are the admixture composition according to the conventional one. In these tests, 30 cycles of lubricant spray were performed under following the conditions: oil temperature of the lubricant of 30–35° C., injector flow rate of 170±5 ml/min. and spray pressure of 17.5±0.35 MPa and, after that, the dynamic viscosity of the lubricant was measured at an oil temperature of 100° C. In these tests, a diesel injector commercially available from BOSCH was employed and 1 cycle was set at 1 minute, according to the above-mentioned standards. Also, measurements of the dynamic viscosity were carried out according to JIS K2283 and ASTM D446. The measurements of the dynamic viscosity were carried out before and after each test, and the ratio of the difference between the dynamic viscosities before and after the test to the dynamic viscosity before the test was evaluated as a viscosity drop ratio.

Example 1

A DICH oil solution was prepared by dissolving star DICH having a viscosity average molecular weight of 580,000 in a base oil for a liquid lubricant at a concentration of 11 weight %. Similarly, a PIB oil solution was prepared by dissolving PIB having a viscosity average molecular weight of 1,200,000 in the base oil of the PIB oil solution at a concentration of 11 weight % to form the PIB oil solution. Further, the prepared DICH oil solution was mixed with the liquid lubricant at a concentration of 3.5 weight %, and the prepared PIB oil solution was mixed with the liquid lubricant at a concentration of 20 weight %. As such, the admixture composition according to the present invention was mixed with the liquid lubricant, and a Viscosity Grade A liquid lubricant was produced.

Example 2

The DICH oil solution and the PIB oil solution were prepared in a same manner to Example 1, and the prepared DICH oil solution was mixed with the liquid lubricant at a concentration of 7.0 weight %, and the prepared PIB oil solution was mixed with the liquid lubricant at the concentration of 20 weight %. As such, the admixture composition according to the present invention was mixed with the liquid lubricant, and a Viscosity Grade B liquid lubricant was produced.

Example 3

The DICH oil solution and the PIB oil solution were prepared in a same manner to Example 1, and the prepared DICH oil solution was mixed with the liquid lubricant at a concentration of 4.3 weight %, and the prepared PIB oil solution was mixed with the liquid lubricant at a concentration of 20 weight %. As such, the admixture composition according to the present invention was mixed with the liquid lubricant, and a Viscosity Grade C liquid lubricant was produced.

Example 4

The DICH oil solution and the PIB oil solution were prepared in a same manner to Example 1, and the prepared DICH oil solution was mixed with the liquid lubricant at a concentration of 11 weight %, and the prepared PIB oil solution was mixed with the liquid lubricant at a concentration of 20 weight %. As such, the admixture composition according to the present invention was mixed with the liquid lubricant, and a Viscosity Grade D liquid lubricant was produced.

Example 5

The DICH oil solution and the PIB oil solution were prepared in a similar manner to Example 1, and the prepared DICH oil solution was mixed with the liquid lubricant at a concentration of 10.8 weight %, and the prepared PIB oil solution was mixed with the liquid lubricant at a concentration of 20 weight %. As such, the admixture composition according to the present invention was mixed with the liquid lubricant, and a Viscosity Grade E liquid lubricant was produced.

(Control 1)

An olefin copolymer (hereinafter called OCP) oil solution was prepared by dissolving an olefin copolymer, that is, an ethylene-propylene copolymer having a viscosity average molecular weight of 550,000 in a base oil for a liquid lubricant at a concentration of 10 weight %. Further the prepared OCP oil solution was mixed with the liquid lubricant at a concentration of 30 weight %. The PIB oil solution was prepared and mixed with the liquid lubricant in a same manner to the Example 1. As such, the conventional admixture composition with OCP and PIB was mixed with the liquid lubricant, and a Viscosity Grade A liquid lubricant was produced.

(Control 2)

The OCP oil solution and the PIB oil solution were prepared in a same manner to the Control 1, and the prepared OCP oil solution was mixed with the liquid lubricant at a concentration of 30 weight %, and the prepared PIB oil solution was mixed with the liquid lubricant at a concentration of 20 weight %. As such, the conventional admixture composition was mixed with the liquid lubricant, and a Viscosity Grade B liquid lubricant was produced.

(Control 3)

The OCP oil solution and the PIB oil solution were prepared in a same manner to the Control 1, and the prepared OCP oil solution was mixed with the liquid lubricant at a concentration of 30 weight %, and the prepared PIB oil solution was mixed with the liquid lubricant at a concentration of 20 weight %. As such, the conventional admixture composition was mixed with the liquid lubricant, and a Viscosity Grade C liquid lubricant was produced.

(Control 4)

The OCP oil solution and the PIB oil solution were prepared in a similar manner to the Control 1, and the, prepared OCP oil solution was mixed with the liquid lubricant at a concentration of 30 weight %, and the prepared PIB oil solution was mixed with the liquid lubricant at a concentration of 20 weight %. As such, the conventional admixture composition was mixed with the liquid lubricant, and a Viscosity Grade D liquid lubricant was produced.

(Control 5)

A OCP oil solution and the PIB oil solution were prepared in a similar manner to the Comparative Example 1, and the prepared OCP oil solution was mixed with the liquid lubricant at a concentration of 30 weight %, and the prepared PIB oil solution was mixed with the liquid lubricant at a concentration of 20 weight %. As such, the conventional admixture composition was mixed with the liquid lubricant, and a Viscosity Grade E liquid lubricant was produced.

The liquid lubricants of Examples 1–5 and Control 1–5 additionally include various additive components that do not affect the shear stability, in addition to the lubricant according to the present invention i.e., PIB and star DICH.

TABLE 1

| | DIESEL INJECTOR TEST | | | | | | | | | |
|---|---|---|---|---|---|---|---|---|---|---|
| | A | | B | | C | | D | | E | |
| Viscosity Grade | Example 1 | Control 1 | Example 2 | Control 2 | Example 3 | Control 3 | Example 4 | Control 4 | Example 5 | Control 5 |
| 100° C. VIS ($mm^2/s$) Before Test | 10.46 | 10.77 | 14.55 | 14.51 | 14.31 | 14.80 | 17.48 | 17.75 | 23.39 | 23.32 |
| 100° C. VIS ($mm^2/s$) After Test | 9.225 | 8.782 | 12.73 | 10.78 | 12.47 | 11.96 | 15.60 | 11.80 | 18.9 | 15.29 |
| Viscosity Drop Ratio (%) | 11.81 | 18.46 | 12.51 | 25.71 | 12.86 | 19.19 | 10.76 | 33.52 | 19.20 | 34.43 |

Figure 2:
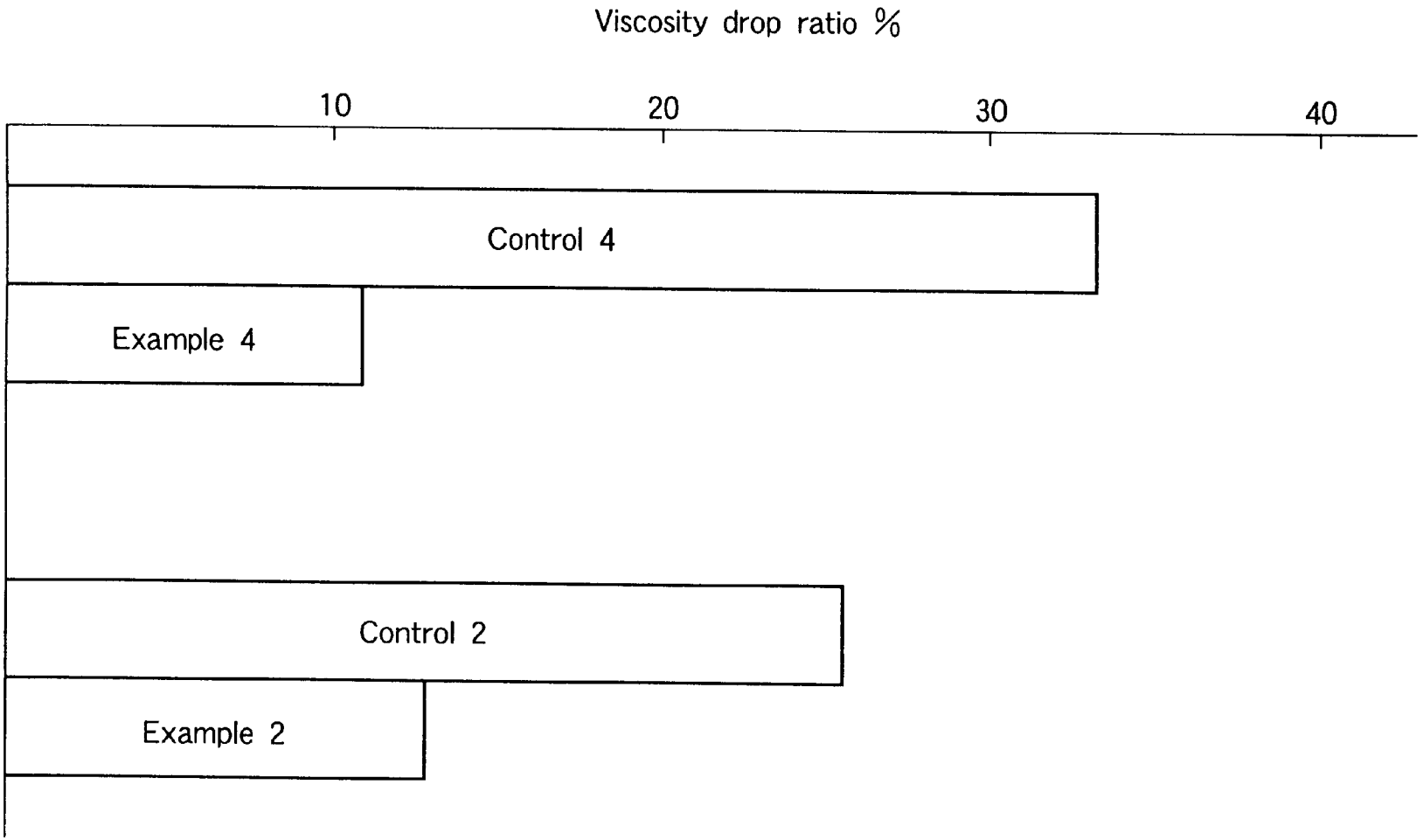
FIG. 2 is a graph showing a comparison between the viscosity drop ratio of a liquid lubricant containing the conventional admixture composition and the viscosity drop ratio of a liquid lubricant containing a admixture composition according to the present invention.

The results of these shear tests are shown in Table 1 and FIG. 2. As shown in Table 1, for the liquid lubricant of the respective grades, the viscosity drop ratio is lower in Examples 1–5 than in Control 1–5. In particular, as shown in FIG. 2, Example 2 of Viscosity Grade B and Example 4 of Viscosity Grade D show a viscosity drop ratio ranging from 1/2 to 1/3 compared with Control 2 and Control 4, respectively.

Next, an example performing an ultrasonic shear stability test for the admixture composition itself according to the present invention is shown. In this test, a test was performed on the admixture composition of Example 6 and Control 6 shown below, according to JASO M347-95. In these tests, the admixture composition was subjected to ultrasonic waves at a water-cooling temperature of the lubricant of 40° C., at 11.5 V of the of output indication voltage of the ultrasonic generator for 60 minutes, and then the dynamic viscosity was measured at an oil temperature of the lubricant of 100° C. Also, the dynamic viscosity was measured according to JIS K2283 and/or ASTM D446. The measurements of the dynamic viscosity were performed before the test and after the test, and the ratio of the difference between the dynamic viscosities before and after the test to the dynamic viscosity before the test was evaluated as a viscosity drop ratio.

Example 6

A DICH oil solution was prepared by dissolving star DICH having a viscosity average molecular weight of 580,000 in a base oil for a liquid lubricant at a concentration of 11 weight %. Similarly, a PIB oil solution was prepared by dissolving PIB having a viscosity average molecular weight of 1,200,000 in a base oil for a liquid lubricant at a concentration of 11 weight %. The prepared DICH oil solution and the prepared PIB oil solution were blended at a predetermined ratio to produce an admixture composition including PIB and star DICH. Such an admixture composition according to the present invention is for production of a commercial product as an additive, which can be mixed with a lubricant that has been produced as a commercial product separately.

(Control 6)

An OCP oil solution was prepared by dissolving an ethylene-propylene copolymer having a viscosity average molecular weight of 550,000 in a base oil for a liquid lubricant at a concentration of 10 weight %. PIB was processed into the PIB oil solution in a same manner as in Example 6. The prepared OCP oil solution and the prepared PIB oil solution were blended at a predetermined ratio to produce an admixture composition including OCP and PIB.

The admixture composition according to Example 6 and Control 6 are for production of commercial products as additives that are subsequently added to the commercially available lubricants, and therefore these admixture composition have a higher concentration of PIB and star DICH, or OCP than in the admixture composition of Examples 1–5 and Control 1–5. The concentrations of PIB and star DICH in the admixture composition, i.e., the ratio of the DICH oil solution and the PIB oil solution during the production of the admixture composition, are determined depending upon the added quantity of these admixture composition as additives into the liquid lubricants, so that the added quantity of the DICH oil solution is at a concentration in the range of 3 weight % to 90 weight % to the lubricant and the added quantity of the PIB oil solution is at a concentration of in the range of 10 weight % to 90 weight %, or OCP oil solution is at a concentration in the range of 10 weight % to 80 weight % and the PIB oil solution is at a concentration in the range of 10 weight % to 90 weight %.

Also, the additives including the admixture composition of Example 6 and Control 6 additionally include various additive components that do not affect the shear stability, in addition to PIB and star DICH.

TABLE 2

ULTRASONIC SHARE STABILITY TEST

| | Example 6 | Control 6 |
|---|---|---|
| 100° C. VIS ($mm^2/s$) Before Test | 253.2 | 234.9 |
| 100° C. VIS ($mm^2/s$) After Test | 219.9 | 138.2 |
| Viscosity Drop Ratio (%) | 13.15 | 41.17 |

The results of these shear stability tests are shown in Table 2. As shown in Table 2, Example 6 provided a lower viscosity drop ratio than Control 6.

As such, the admixture composition according to the present invention can provide an improvement in the mechanical shear force resistance.

Further, by improving the mechanical shear force resistance of the admixture composition, the advantageous effects obtained by mixing the admixture composition of U.S. Pat. No. 4,788,362 with the lubricants can be provided for longer.

What is claimed is:

1. A admixture composition for mixing with a lubricant, comprising:

an oil solution of polyisobutylene, containing polyisobutylene having a viscosity average molecular weight in a range of 350,000 to 2,100,000 at a concentration in the range of 10 weight % to 90 weight %; and an oil solution of star divinylbenzene-isoprene copolymer hydride being a viscosity index improver, containing star divinylbenzene-isoprene copolymer hydride having a viscosity average molecular weight in a range of 200,000 to 800,000 at a concentration in the range from 3 weight % to 90 weight %, wherein said oil solution of polyisobutylene mixes with a lubricant at a concentration in the range from 10 weight % to 90 weight % and said oil solution of star divinylbenzene-isoprene copolymer hydride mixes with the lubricant at a concentration in the range of 3 weight % to 90 weight %.

2. The admixture composition for mixing with a lubricant according to claim 1, wherein the viscosity average molecular weight of said star divinylbenzene-isoprene copolymer hydride is in a range of 400,000 to 650,000.

* * * * *